US010001737B2

(12) United States Patent
Ota

(10) Patent No.: US 10,001,737 B2
(45) Date of Patent: Jun. 19, 2018

(54) IMAGE FORMING APPARATUS

(71) Applicant: KYOCERA Document Solutions Inc., Osaka (JP)

(72) Inventor: Katsuya Ota, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days. days.

(21) Appl. No.: 15/714,472

(22) Filed: Sep. 25, 2017

(65) Prior Publication Data

US 2018/0101115 A1 Apr. 12, 2018

(30) Foreign Application Priority Data

Oct. 6, 2016 (JP) ..... 2016-198491

(51) Int. Cl.

| | |
|---|---|
| ***G03G 21/00*** | (2006.01) |
| ***G03G 15/00*** | (2006.01) |
| ***G03G 15/16*** | (2006.01) |
| ***G03G 15/08*** | (2006.01) |

(52) U.S. Cl.

CPC ..... *G03G 15/5062* (2013.01); *G03G 15/0877* (2013.01); *G03G 15/1695* (2013.01); *G03G 21/0005* (2013.01)

(58) Field of Classification Search

CPC ..... G03G 15/0877; G03G 15/1695; G03G 15/5062; G03G 21/0005

See application file for complete search history.

(56) References Cited

U.S. PATENT DOCUMENTS

| | | | | |
|---|---|---|---|---|
| 7,729,653 | B2 * | 6/2010 | Kawamoto | G03G 21/0005 399/343 |
| 8,925,458 | B2 * | 1/2015 | Moore | B08B 1/00 101/423 |
| 2002/0034397 | A1 * | 3/2002 | Shimizu | G03G 15/0225 399/100 |

FOREIGN PATENT DOCUMENTS

JP 2001-142366 A 5/2001

* cited by examiner

*Primary Examiner* — Hoang Ngo
(74) *Attorney, Agent, or Firm* — IP Business Solutions, LLC

(57) ABSTRACT

An image forming apparatus includes: an image carrier, a developing section, a transfer roller, a power supply section, a conveyance roller, and an operation control section. The operation control section has a cleaning operation mode and an image formation operation mode where images are formed on recording paper. In the cleaning operation mode, the operation control section causes the developing section to supply a predefined amount of toner to a circumferential surface of the image carrier, causes the power supply section to apply a bias of a polarity opposite to a normal charge polarity to the transfer roller, then causes the conveyance roller to convey a single piece of recording paper, causes the conveyance roller to stop rotating operation when the recording paper is located in a nip area, and causes the image carrier and the transfer roller to rotate while the recording paper is stopped in the nip area.

9 Claims, 6 Drawing Sheets

IMAGE FORMING APPARATUS

INCORPORATION BY REFERENCE

This application claims priority to Japanese Patent Application No. 2016-198491 filed on Oct. 6, 2016, the entire contents of which are incorporated by reference herein.

BACKGROUND

This disclosure relates to an electrophotographic image forming apparatus.

With the electrophotographic image forming apparatus, a toner is supplied to a circumferential surface of an image carrier such as a photoconductive drum and then a toner image formed on the circumferential surface of the image carrier is transferred onto recording paper to thereby form an image on the recording paper.

Here, provided at a position along the circumferential surface of the image carrier is a cleaning device for collecting the toner remaining on the circumferential surface of the image carrier after the transfer. The cleaning device is composed of: a cleaning blade formed of plate-like urethane rubber which makes contact with the circumferential surface of the image carrier to scrape the toner remaining on the circumferential surface of the image carrier; a collection roller which collects the toner scraped by the cleaning blade; etc. However, upon scraping the toner remaining on the circumferential surface of the image carrier by the cleaning blade, an external additive contained in the toner may firmly adhere to the circumferential surface of the image carrier. Moreover, a foreign substance adhering to the recording paper may adhere to the circumferential surface of the image carrier. It is difficult to remove the aforementioned foreign substance by the cleaning device, and in a case where image formation processing is performed while the aforementioned foreign substance is adhering to the circumferential surface of the image carrier, quality of the formed image may be degraded.

Disclosed for this problem is a technology of stopping the recording paper at a nip area located between the image carrier and a transfer roller by a conveyance roller which conveys the recording paper and rotating the image carrier and the transfer roller in this state to thereby remove the foreign substance adhering to the image carrier.

SUMMARY

As one aspect of this disclosure, a technology obtained by further improving the technology described above will be suggested.

An image forming apparatus according to one aspect of this disclosure includes: an image carrier, a developing section, a transfer roller, a power supply section, a conveyance roller, and an operation control section.

The image carrier of a rotatable cylindrical shape.

The developing section supplies a toner to a circumferential surface of the image carrier.

The transfer roller is arranged oppositely to the image carrier.

The power supply section applies a bias to the transfer roller.

The conveyance roller is provided on a more upstream side in a recording paper conveyance direction than a nip area located between the image carrier and the transfer roller, and conveys recording paper to the nip area.

The operation control section controls conveyance operation performed by the conveyance roller, developing operation performed by the developing section, rotating operation of the image carrier, and transfer operation performed by the transfer roller and the power supply section.

Further, the operation control section has a cleaning operation mode in addition to an image formation operation mode in which an image is formed on recording paper. In the cleaning operation mode, the operation control section causes the developing section to supply a predefined amount of toner to the circumferential surface of the image carrier and also causes the power supply section to apply a bias of a polarity opposite to a normal charge polarity to the transfer roller, then causes the conveyance roller to convey a single piece of recording paper, causes the conveyance roller to stop rotating operation when the recording paper is located in the nip area, and causes the image carrier and the transfer roller to rotate while the single piece of recording paper is stopped in the nip area.

DETAILED DESCRIPTION

Hereinafter, an image forming apparatus according to an embodiment as one aspect of this disclosure will be described with reference to the drawings.

Figure 1:
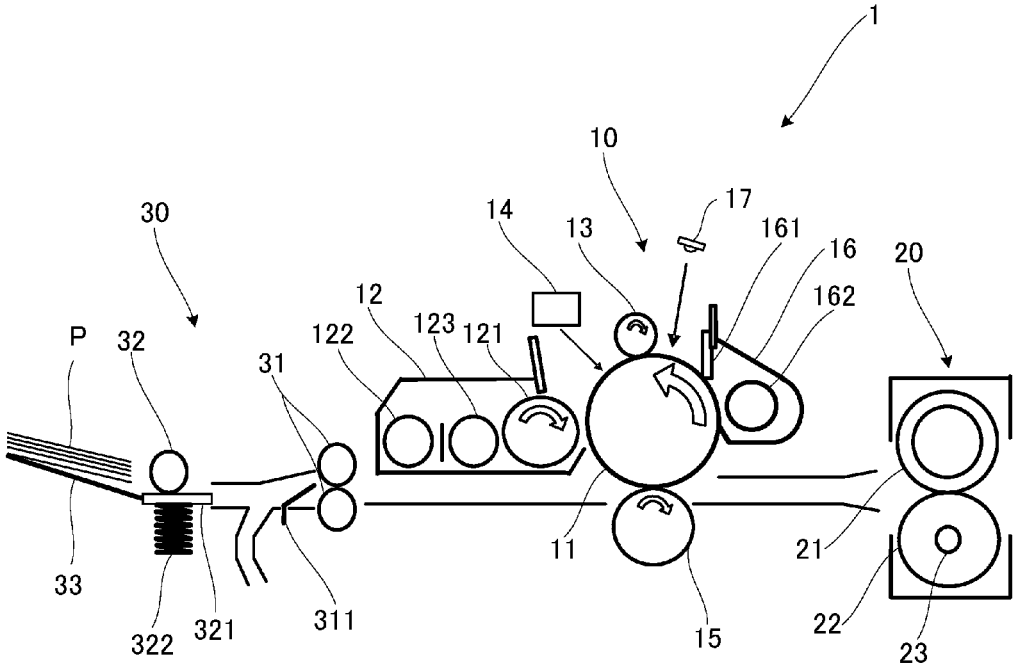
FIG. 1 is a sectional view illustrating mechanical configuration of an image forming apparatus according to one embodiment of this disclosure.

FIG. 1 is a sectional view illustrating mechanical configuration of the image forming apparatus according to one embodiment of this disclosure. The image forming apparatus 1 is a black and white printer which forms an image on recording paper through a so-called electrophotographic method, and includes: an image formation section 10; a fixing section 20; a conveyance mechanism 30 which conveys recording paper; etc.

The image formation section 10 includes: a photoconductive drum 11; a developing device 12; a toner cartridge (not illustrated) which stores a toner; a charging roller 13; an exposure device 14; a transfer roller 15, a cleaning device 16; a neutralization device 17, etc.

The photoconductive drum 11 (image carrier) is a member which is formed of an organic photoconductor of a cylindrical shape with a diameter of 30 mm, and is rotatably supported in a housing of the image forming apparatus. The photoconductive drum 11 is rotated in an arrow direction in FIG. 1 by a photoconductive drum driving section 111 (see FIG. 2) composed of a motor, a gear, etc.

The charging roller 13 includes: a shaft of metal with a diameter of 8 mm; and a rubber layer (epichlohydrin rubber) with a diameter of 12 mm which covers a circumferential surface of the shaft. The charging roller 13 is arranged at a predefined position along a circumferential surface of the photoconductive drum 11, and makes contact with the circumferential surface of the photoconductive drum 11 to uniformly charge the circumferential surface of the photoconductive drum 11.

The exposure device 14 is a so-called laser exposure device, and includes: a laser light source which outputs a laser beam; a polygon mirror which reflects the laser beam towards the circumferential surface of the photoconductive drum 11; and optical components, such as a lens and a mirror, for guiding, towards the photoconductive drum 11, laser beam reflected by the polygon mirror. The exposure device 14 is arranged at a predefined position along the circumferential surface of the photoconductive drum 11, and irradiates laser light based on image data inputted to the image forming apparatus 1 to the circumferential surface of the photoconductive drum 11 already subjected to the charging to form an electrostatic latent image on the circumferential surface of the photoconductive drum 11.

The developing device 12 includes a developing roller 121, a first feeder 122, and a second feeder 123. The toner moved from the first feeder 122 and the second feeder 123 is carried on a circumferential surface of the developing roller 121. As a result of applying a developing bias to the developing roller 121, the toner on the circumferential surface of the developing roller 121 moves to the photoconductive drum 11 whereby the electrostatic latent image formed on the photoconductive drum 11 is developed into a toner image.

Figure 3:
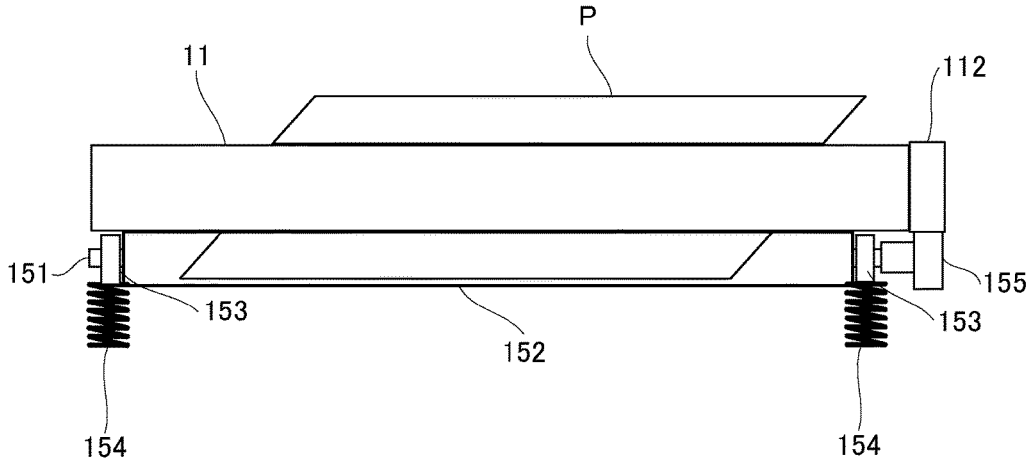
FIG. 3 is a diagram illustrating detailed configuration of a transfer roller of the image forming apparatus according to one embodiment of this disclosure.

The transfer roller 15 is a roller of ethylene propylene diene rubber (EPDM) with a diameter of 20 mm which is arranged at a predefined position along the circumferential surface of the photoconductive drum 11. FIG. 3 is a diagram illustrating detailed configuration of the transfer roller 15. As illustrated in the figure, the transfer roller 15 is composed of: a shaft 151 of metal with a diameter of 8 mm; and an EPDM foam 152 with a thickness of 6 mm which covers the shaft 151 and which is electrically conductive.

The transfer roller 15 has the aforementioned shaft 151 supported by bearings 153 of conductive resin provided at both end parts of the transfer roller 15. Each of the bearings 153 is biased towards the photoconductive drum 11 by a spring 154, and a force of the biasing presses the transfer roller 15 against the photoconductive drum 11. The spring 154 is connected to a transfer bias application section 156 (see FIG. 2). The transfer roller 15 receives a bias applied from the transfer bias application section 156 via the spring 154. The toner image formed on the circumferential surface of the photoconductive drum 11 is transferred onto recording paper P in a nip area located between the transfer roller 15 and the photoconductive drum 11 by the bias which has been applied from the transfer bias application section 156.

A flange gear 112 is provided at one end part of the photoconductive drum 11. Moreover, a drive gear 155 is provided at one end part of the shaft 151 of the transfer roller 15. Upon rotation of the photoconductive drum 11 as a result of being driven by the photoconductive drum driving section 111, a driving force is transmitted to the drive gear 155 by the flange gear 112. As a result, the transfer roller 15 rotates in the arrow direction in FIG. 1 following the rotation of the photoconductive drum 11. In this embodiment, with the aforementioned flange gear 112 and drive gear 155, a ratio between a circumferential speed of the photoconductive drum 11 and a circumferential speed of the transfer roller 15 is 1.06.

The cleaning device 16 includes: a cleaning blade 161 of plate-like urethane rubber which makes contact with the circumferential surface of the photoconductive drum 11 to scrape the toner remaining on the circumferential surface of the photoconductive drum 11 already subjected to the transfer; and a collection roller 162 which collects the toner scraped by the cleaning blade 161.

The neutralization device 17 has a light emitting diode light source (LED), from which light is irradiated to the circumferential surface of the photoconductive drum 11 to thereby neutralize electric charges remaining on the circumferential surface of the photoconductive drum 11 already subjected to the transfer.

The fixing section 20 includes a heating roller 21 and a pressure roller 22. The heating roller 21 includes therein a light source such as a halogen lamp. The pressure roller 22 has a shaft 23 biased by a spring or the like in a direction approaching the heating roller 21, thereby bringing the pressure roller 22 to make pressure-contact with the heating roller 21. The recording paper P on which the toner image has been transferred is heated and pressurized in a nip area located between the pressure roller 22 and the heating roller 21, whereby the toner image on the recording paper P is fixed. Then the recording paper P is discharged to an outside of the image forming apparatus 1.

The conveyance mechanism 30 is structured for conveying the recording paper P to a predefined position, and includes: a registration roller pair 31, a paper feed roller 32, any other conveyance roller which is provided in the housing of the image forming apparatus 1.

The registration roller pair 31 is a conveyance roller which is rotated by a registration roller pair driving section 312 (see FIG. 2) composed of a motor, a gear, etc. in accordance with an output signal outputted from a registration sensor 311 and which is provided for adjusting timing of conveying the recording paper P. Consequently, a desired toner image is formed at a desired position of the recording paper P in the nip area located between the transfer roller 15 and the photoconductive drum 11.

The paper feed roller 32 is a conveyance roller which is rotated by a paper feed roller driving section 311 (see FIG. 2) composed of a motor, a gear, etc. and which is provided for feeding the recording paper P loaded on a manual feed tray 33. Provided at a position opposing the paper feed roller 32 is the paper feed pad 321. The paper feed pad 321 is pressed by a spring 322 in a direction approaching the paper feed roller 32. A plurality of pieces of recording paper P loaded on the manual feed tray 33 are handled and individually fed by the paper feed pad 321.

Figure 2:
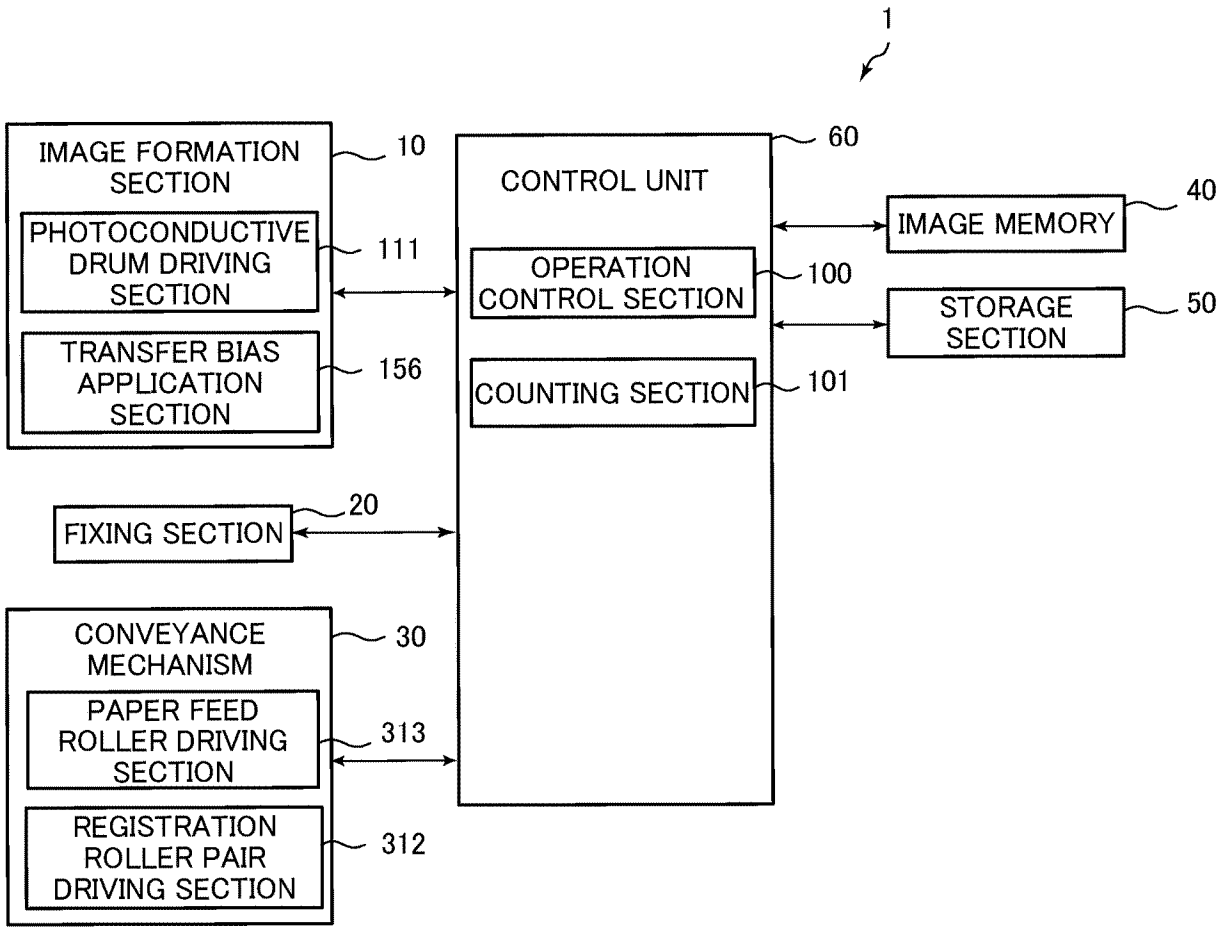
FIG. 2 is a block diagram illustrating inner configuration of the image forming apparatus according to one embodiment of this disclosure.

FIG. 2 is a block diagram illustrating inner configuration of the image forming apparatus according to one embodiment of this disclosure. The same reference numerals are provided for the configuration described in FIG. 1 and overlapping description thereof will be omitted here.

The image forming apparatus 1 further includes: in addition to the configuration described in FIG. 1, an image memory 40, a storage section 50, a control unit 60, etc.

The image memory 40 is a memory which temporarily saves, for example, image data transmitted from, for example, a personal computer (PC) connected to the image forming apparatus 1. The storage section 50 is a large-capacity storage device such as a hard disk drive (HDD). The storage section 50 storages a control program and data required for operation of the image forming apparatus 1.

The control unit 60 includes: processors such as a central processing unit (CPU) and a digital signal processor (DSP); and memories such as a random access memory (RAM) and a read only memory (ROM). As a result of executing the control program stored in, for example, the aforementioned memory or the storage section 50 by the aforementioned processor, the control unit 60 functions as an operation control section 100 and a counting section 101. Note that each of the aforementioned structures of the control unit 60 may be formed by a hard circuit without depending on operation performed based on the above-mentioned control program.

The counting section 101 has a function of counting a number of pieces of paper printed by the image forming apparatus 1 (a number of pieces of printed paper) since shipment thereof from a plant. The counting section 101 counts a number of pieces of paper printed by use of the transfer roller 15, and in a case where the transfer roller 15 is replaced with a new one through maintenance, the number of pieces of printed paper counted is 0. In a case where the image forming apparatus 1 includes, for example, a mechanism (sensor) of detecting replacement of the transfer roller 15, the counting section 101 detects the replacement of the transfer roller 15 based on a signal outputted from this mechanism. Moreover, in a case where an instruction indicating that the transfer roller 15 has been replaced is inputted to the image forming apparatus 1 by, for example, a user or a service man, the count section 101 detects the replacement of the transfer roller 15 based on this instruction.

The operation control section 100 is in charge of overall operation control of the image forming apparatus 1. More specifically, the operation control section 100 controls: image formation operation performed by the image formation section 10; fixing operation performed by the fixing section 20; recording paper conveyance operation performed by the conveyance mechanism 30; etc.

In the control of the image formation operation performed by the image formation section 10, the operation control section 100 adjusts driving of the photoconductive drum driving section 111 to control rotating operation of the photoconductive drum 11. The operation control section 100 also controls the developing operation of the developing device 12. Further, the operation control section 100 adjusts intensity of the bias applied by the transfer bias application section 156 and timing of applying the bias to control the transfer operation of the transfer roller 15.

In the control of the conveyance operation performed by the conveyance mechanism 30, the operation control section 100 adjusts driving of the paper feed roller driving section 311 to control recording paper feed operation performed by the paper feed roller 32. The operation control section 100 also adjusts driving of the registration roller pair driving section 312 to control the recording paper conveyance operation performed by the registration roller pair 31.

Here, a foreign substance present on the circumferential surface of the photoconductive drum 11 may not be removed by the cleaning device 16. For example, upon scraping the toner remaining on the circumferential surface of the photoconductive drum 11 by the cleaning blade 161, an external additive contained in the toner may firmly adhere to the circumferential surface of the photoconductive drum 11. Moreover, a foreign substance adhering to the recording paper may adhere to the circumferential surface of the photoconductive drum 11. It is difficult to remove the aforementioned foreign substance by the cleaning device 16, and thus in a case where image formation processing is performed while the aforementioned foreign substance is adhering to the circumferential surface of the photoconductive drum 11, quality of a formed image deteriorates.

To remove such a foreign substance adhering to the circumferential surface of the photoconductive drum 11, the operation control section 100 has, in addition to an image formation operation mode in which an image is formed on recording paper, a cleaning operation mode.

In the cleaning operation mode, the operation control section 100 causes the developing device 12 to supply a predefined amount of the toner to the circumferential surface of the photoconductive drum 11, then causes the registration roller pair 31 to convey a single piece of recording paper, and causes the photoconductive drum 11 and the transfer roller 15 to rotate while the aforementioned single piece of recording paper is stopped in the nip area located between the photoconductive drum 11 and the transfer roller 15. Hereinafter, details of the above will be described.

Figure 4:
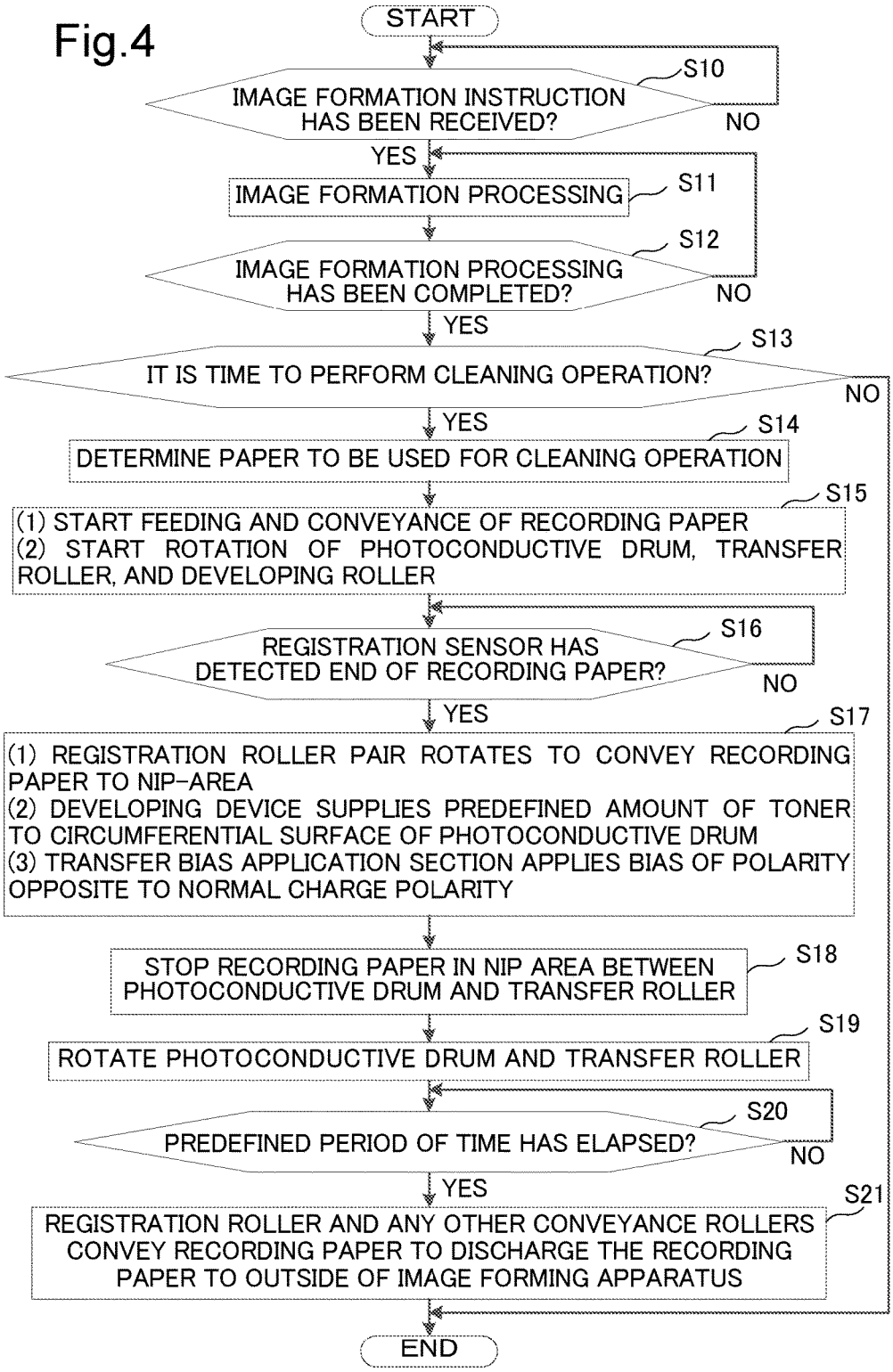
FIG. 4 is a flowchart illustrating a flow of operation of the image forming apparatus according to one embodiment of this disclosure.

FIG. 4 is a flowchart illustrating a flow of the operation of the image forming apparatus 1. As illustrated in the figure, when an image formation instruction has been inputted by the user and the operation control section 100 has received the image formation instruction (YES in step S10), the operation control section 100 controls the image formation section 10, the fixing section 20, the conveyance mechanism 30, etc. to execute image formation processing of forming an image on recording paper (step S11).

Then upon completing the image formation processing performed in step S11 (YES in step S12), the operation control section 100 determines whether or not it is time to perform cleaning operation. The operation control section 100 executes the cleaning operation, for example, every time when a predefined number of pieces of paper is printed. The operation control section 100 may also execute the cleaning operation every time when a predefined period of time elapses.

In a case where it is not time to perform the cleaning operation (NO in step S13), the operation control section 100 ends the processing. On the other hand, in a case where it is time to perform the cleaning operation (YES in step S13), the operation control section 100 executes the processing to be performed in step S14 and beyond.

In the processing of step S14, the operation control section 100 performs processing of determining paper to be used for the cleaning operation. More specifically, the operation control section 100 determines, out of pieces of paper set in a paper feed cassette included in the image forming apparatus 1, the paper of a largest size as the paper to be used for the cleaning operation. Moreover, in a case where any paper is set on the manual feed tray 33, the image formation section 10 determines the aforementioned paper as the paper to be used for the cleaning operation and also specifies a size of this paper based on an output signal provided from a sensor provided at the manual feed tray 33.

After the processing of step S14, in the processing of step S15, the operation control section 100 causes the paper feed roller 32 and any other conveyance roller to rotate to start conveyance of the single piece of recording paper determined in the processing of step S14. Moreover, the operation control section 100 causes the paper feed roller 32, etc. to rotate and also simultaneously causes the photoconductive drum 11, the transfer roller 15, and the developing roller 121 to rotate.

Upon detecting a tip of the recording paper by the registration sensor 311 (YES in step S16), the operation control section 100 causes the registration roller pair 31 to rotate to convey the recording paper to the nip area located between the photoconductive drum 11 and the transfer roller 15 (step S17). With reference to timing of rotating the registration roller pair 31, the operation control section 100 causes the developing roller 121 to apply a high-frequency voltage to supply the predefined toner to the circumferential surface of the photoconductive drum 11 (step S17). At this point, a potential of the circumferential surface of the photoconductive drum 11 is in a substantially zero state, a toner image is formed on the circumferential surface of the photoconductive drum 11 through the aforementioned toner supply. A length of the toner image in an axial direction of the photoconductive drum 11 is equal to or greater than a length of the toner image in an axial direction of the transfer roller 15, and a length of the toner image in a rotation direction of the photoconductive drum 11 is equal to or greater than a length of the toner image in a rotation direction of the transfer roller 15.

Figure 5:
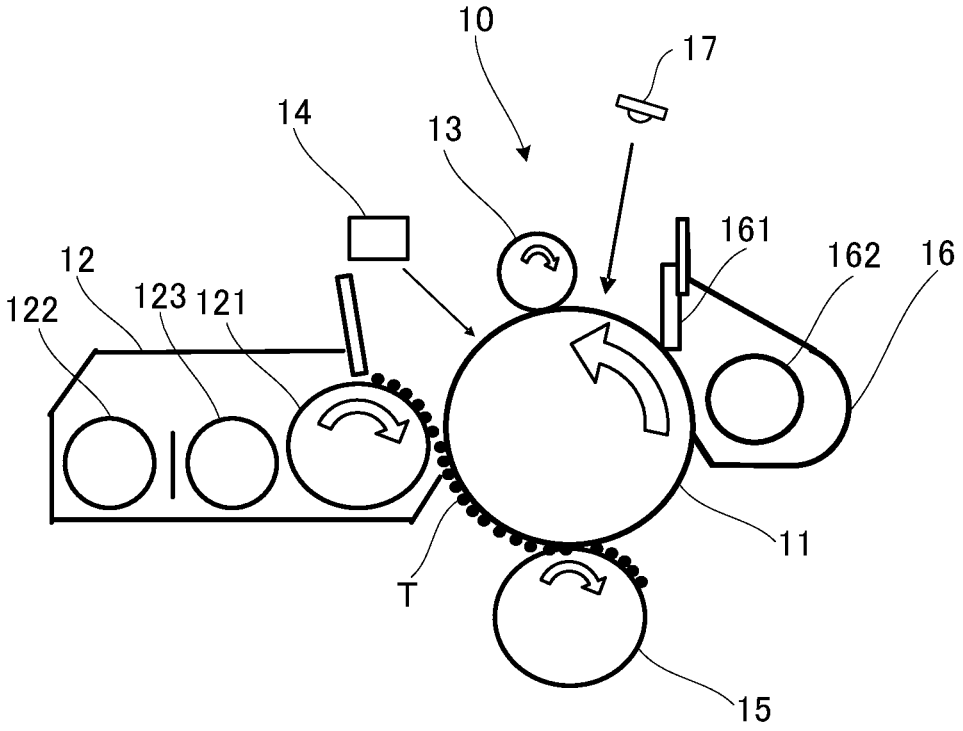
FIG. 5 is a diagram schematically illustrating a flow of a toner in cleaning operation.

Moreover, in the aforementioned processing of step S17, the operation control section 100 causes the transfer bias application section 156 to apply a bias of a polarity opposite to a normal charge polarity of the toner (the normal charge polarity is positive, and the polarity opposite thereto is negative in this embodiment) before the toner image formed on the circumferential surface of the photoconductive drum 11 approaches the nip area located between the photoconductive drum 11 and the transfer roller 15. Consequently, as illustrated in FIG. 5, the toner image T formed on the circumferential surface of the photoconductive drum 11 moves to a circumferential surface of the transfer roller 15.

The operation control section 100 controls the rotation of the registration roller pair 31 in a manner such that the recording paper reaches the nip area at timing immediately after the movement of the toner image to the circumferential surface of the transfer roller 15 ends. Then the operation control section 100 controls the rotation of the registration roller pair 31 to stop the recording paper in the nip area (step S18). At this point, the operation control section 100 stops the recording paper at a portion at which the tip of the recording paper does not reach the fixing section 20. In this embodiment, the operation control section 100 stops the recording paper at a position where the tip of the recording paper is forwarded towards the fixing section 20 from the nip area by approximately 20 mm.

The operation control section 100 causes the photoconductive drum 11 and the transfer roller 15 to rotate for approximately 30 seconds while the recording paper is stopped in the nip area (step S19). The operation control section 100 continues the application of the bias of the polarity opposite to the normal charge polarity by the transfer bias application section 156 until the rotation of the photoconductive drum 11 and the transfer roller 15 is ended. Consequently, the rotation of the photoconductive drum 11 and the transfer roller 15 is performed while the toner is held on the circumferential surface of the transfer roller 15.

Here, in a case where the number of pieces of paper printed since the shipment from the plant (the number of pieces of printed paper) is small and the transfer roller 15 is nearly a brand-new product, there arises a condition such that an amount of the external additive of the toner adhering to the circumferential surface of the transfer roller 15 is small and thus a friction coefficient of the circumferential surface of the transfer roller 15 is high. With such a high friction coefficient of the circumferential surface of the transfer roller 15, a force of the recording paper conveyance achieved through the rotation of the photoconductive drum 11 and the transfer roller 15 becomes greater than a force of the recording paper stopping by the registration roller pair 31, leading to a risk of a condition such that the recording paper cannot be stopped.

In this point, with the image forming apparatus 1 described above, the rotation of the photoconductive drum 11 and the transfer roller 15 is performed while the toner is held on the circumferential surface of the transfer roller 15, thus decreasing the force of the recording paper conveyance achieved through the rotation of the photoconductive drum 11 and the transfer roller 15. Thus, even in a case where the transfer roller 15 is nearly a brand-new product and the friction coefficient of the circumferential surface of the transfer roller 15 is high, it is possible to clean the circumferential surface of the photoconductive drum 11 by rotating the photoconductive drum 11 and the transfer roller 15 while the recording paper is stopped in the nip area.

In a case where a predefined period of time (approximately 30 seconds) has elapsed since the processing of step S19 was performed (YES in step S20), the operation control section 100 causes the registration roller pair 31 and any other conveyance roller thereof to rotate to discharge the recording paper to the outside of the image forming apparatus 1 (step S21).

Moreover, after passage of a rear end of the recording paper through the nip area, the operation control section 100 causes the transfer bias application section 156 to apply a bias of the same polarity as the normal charge polarity and also causes the transfer roller 15 to rotate for at least one rotation. Consequently, the toner on the circumferential surface of the circumferential surface of the transfer roller 15 can be moved to the photoconductive drum 11. The toner moved to the photoconductive drum 11 is removed by the cleaning device 16.

For example, in a case where the number of pieces of paper printed since the shipment from the plant (the number of pieces of printed paper) is small and the transfer roller is nearly a brand-new product, there arises a condition such that the amount of the external additive of the toner adhering to the circumferential surface of the transfer roller is small and thus the friction coefficient of the circumferential surface of the transfer roller is high. With the disclosed technology described in the Background in which the foreign substance adhering to the image carrier is removed by stopping the recording paper in the nip area between the image carrier and the transfer roller and rotating the image carrier and the transfer roller in the aforementioned state, in a case where the friction coefficient of the circumferential surface of the transfer roller is high as described above, there arises a problem such that the force of the recording paper conveyance achieved through the rotation of the image carrier and the transfer roller becomes greater than the force of the recording paper stopping by the conveyance roller, resulting in failure to stop the recording paper.

To increase the force of the recording paper stopping by the conveyance roller, it is required to increase an outer diameter of the conveyance roller or increase pressing of the conveyance roller. Moreover, to reduce the force of the recording paper conveyance achieved through the rotation of the image carrier and the transfer roller, a mechanism of reducing the pressing of the transfer roller is required. Even when any of the aforementioned structures is adopted, a region which is occupied by the required structure in the apparatus increases, upsizing the image forming apparatus.

On the contrary, with the embodiment described above, it is possible to remove the foreign substance adhering to the image carrier without adding new mechanical configuration to configuration included in a typical image forming apparatus.

Note that this disclosure is not limited to the embodiment described above and thus it is possible to make various modifications to this disclosure.

Figure 6:
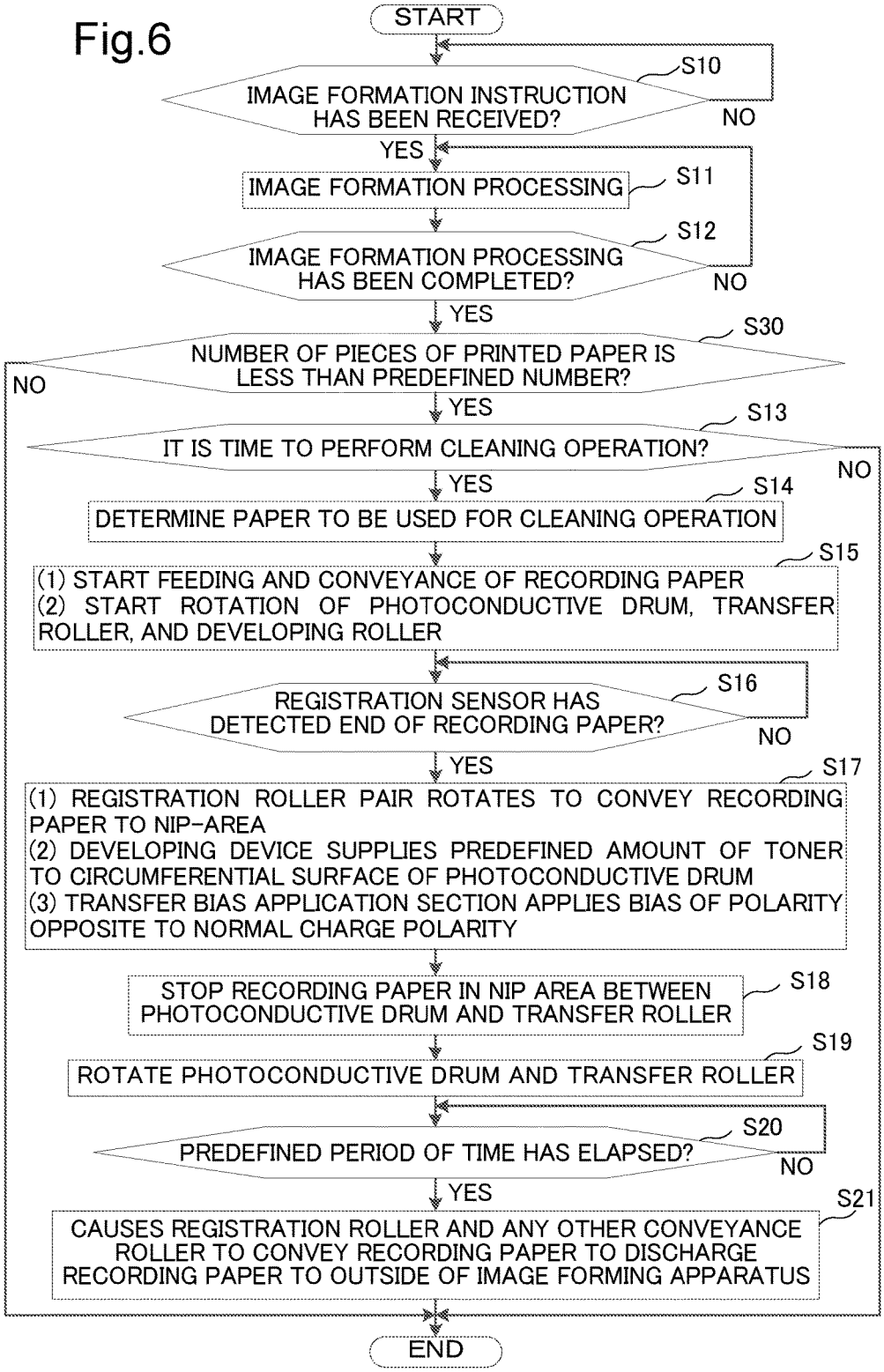
FIG. 6 is a flowchart illustrating a flow of operation of an image forming apparatus according to a modified example.

FIG. 6 is a diagram illustrating a flow of operation of an image forming apparatus according to Modified Example 1. Note that the same reference numerals are provided to processing with the same contents as contents of the processing illustrated in FIG. 4, and overlapping description thereof will be omitted here.

In the image forming apparatus according to Modified Example 1, after the processing of step S12, the operation control section 100 refers to the number of pieces of paper printed by the image forming apparatus 1 since the shipment thereof from the plant (the number of pieces of printed paper), which has been counted by the counting section 101. Then in a case where the number of pieces of printed paper is equal to or greater than a predetermined number (20000) (No in step S30), the operation control section 100 ends the processing without performing the cleaning operation in step S13 and beyond. On the other hand, in a case where the number of pieces of printed paper is less than the predefined number (YES in step S30), the operation control section 100 executes the cleaning operation in step S13 and beyond.

Here, the condition such that the force of the recording paper conveyance achieved through the rotation of the photoconductive drum 11 and the transfer roller 15 becomes greater than the force of the recording paper stopping by the aforementioned registration roller pair 31, resulting in failure to stop the recording paper occurs with a highest possibility when the transfer roller 15 is in a brand-new product state. As printing is performed, a small amount of the toner supplied from the developing roller 121 adheres to a non-toner-image section of the circumferential surface of the photoconductive drum 11. This toner adheres from the circumferential surface of the photoconductive drum 11 to the circumferential surface of the transfer roller 15 when no recording paper passes. As a result, the friction coefficient of the circumferential surface of the transfer roller 15 decreases. Amounts of the toner and the external additive adhering to the circumferential surface of the transfer roller 15 increase as the printing is performed, and thus the friction coefficient of the circumferential surface of the transfer roller 15 gradually decreases as the printing is performed. Then in a case where the friction coefficient of the circumferential surface of the transfer roller 15 becomes equal to or greater than a predefined value, the recording paper can be stopped without proactively supplying the toner to the circumferential surface of the transfer roller 15 as in the embodiment described above.

With the image forming apparatus according to Modified Example 1, in a case where the number of pieces of printed paper is equal to or greater than the predefined number (20000), an amount of toner consumed through the cleaning operation can be reduced by not executing the cleaning operation.

Moreover, with an image forming apparatus according to Modified Example 2, in a case where the number of pieces of printed paper is less than the predefined number, the operation control section 100 causes the developing device 12 to supply a predefined amount of toner to execute the cleaning operation mode, and in a case where the number of pieces of printed paper is equal to or greater than the predefined number, the operation control section 100 causes the developing device 12 to supply an amount of toner smaller than the predefined amount to execute the cleaning operation mode.

Depending on configuration of an image forming apparatus, the friction coefficient of the circumferential surface of the transfer roller 15 decreases through repeated printing, but the friction coefficient does not decrease to the aforementioned predefined value, which may lead to a risk that the recording paper cannot be stopped. However, even in such a case, an amount of toner required for stopping the recording paper is smaller than an amount of toner required for stopping the recording paper when the transfer roller 15 is nearly a brand-new product. Thus, with the image forming apparatus according to Modified Example 2, in a case where the number of pieces of printed paper is equal to or greater than the predefined number, it is possible to cause the developing device 12 to supply a smaller amount of toner than the predefined amount to execute the cleaning operation mode to thereby reduce the amount of toner consumed through the cleaning operation.

Moreover, the embodiment has been described above, referring to a case where the registration roller pair 31 is used to stop the recording paper, but this disclosure is not necessarily limited to this case. The paper feed roller 32 or any other conveyance roller may be used to stop the recording paper.

Moreover, the embodiment has been described above, referring to the black and white printer as the image forming apparatus according to this disclosure, but this is just one example, and the image forming apparatus according to this disclosure may be a color printer or an electronic device, for example, a different image forming apparatus such as a multifunction peripheral, a coper, or a facsimile device.

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:

an image carrier of a rotatable cylindrical shape;

a developing section supplying a toner to a circumferential surface of the image carrier;

a transfer roller being arranged oppositely to the image carrier;

a power supply section applying a bias to the transfer roller;

a conveyance roller being provided on a more upstream side in a recording paper conveyance direction than a nip area located between the image carrier and the transfer roller, the conveyance roller conveying recording paper to the nip area; and an operation control section controlling conveyance operation performed by the conveyance roller, developing operation performed by the developing section, rotating operation of the image carrier, and transfer operation performed by the transfer roller and the power supply section, wherein the operation control section has a cleaning operation mode in addition to an image formation operation mode in which an image is formed on recording paper, and in the cleaning operation mode, the operation control section causes the developing section to supply a predefined amount of toner to the circumferential surface of the image carrier and also causes the power supply section to apply a bias of a polarity opposite to a normal charge polarity to the transfer roller, then causes the conveyance roller to convey a single piece of recording paper, causes the conveyance roller to stop rotating operation when the recording paper is located in the nip area, and causes the image carrier and the transfer roller to rotate while the single piece of recording paper is stopped in the nip area.

2. The image forming apparatus according to claim 1, wherein in the cleaning operation mode, the operation control section causes the power supply section to apply the bias of the polarity opposite to the normal charge polarity to the transfer roller before a toner image formed on the circumferential surface of the image carrier through the toner supply by the developing section approaches the nip area section as a result of rotation of the image carrier.

3. The image forming apparatus according to claim 1, wherein in the cleaning operation mode, the operation control section causes the power supply section to continue the bias application, until the operation of causing the image carrier and the transfer roller to rotate while the recording paper is stopped in the nip area is ended.

4. The image forming apparatus according to claim 3, wherein the operation control section controls the conveyance operation performed by the conveyance roller in a manner such that a tip of the recording paper reaches the nip area after all the predefined amount of toner is moved to a circumferential surface of the transfer roller through the bias application by the power supply section.

5. The image forming apparatus according to claim 1, further comprising a fixing roller being arranged on a more downstream side in the recording paper conveyance direction than the nip area, wherein in the cleaning operation mode, the operation control section controls the conveyance operation performed by the conveyance roller in a manner such that the recording paper is stopped at a position where a tip of the recording paper does not reach the fixing roller.

6. The image forming apparatus according to claim 1, wherein the operation control section causes the power supply section to apply a bias of the normal charge polarity to the transfer roller after performing, for a predefined period of time, the operation of causing the image carrier and the transfer roller to rotate while the recording paper is stopped in the nip area.

7. The image forming apparatus according to claim 1, wherein the operation control section, causes, in the cleaning operation mode, the power supply section to apply the bias of the polarity opposite to the normal charge polarity to the transfer roller before the toner image formed on the circumferential surface of the image carrier through the toner supply by the developing section approaches the nip area as a result of rotation of the image carrier, controls the conveyance operation performed by the conveyance roller in a manner such that a tip of the recording paper reaches the nip area after all the predefined amount of toner is moved to a circumferential surface of the transfer roller through the bias application by the power supply section, controls the conveyance operation performed by the conveyance roller in a manner such that the recording paper is stopped at a position where the tip of the recording paper does not reach the fixing roller, causes the conveyance roller to stop the rotating operation in the aforementioned state and causes the image carrier and the transfer roller to rotate while the recording paper is stopped in the nip area, causes the power supply section to continue the bias application, until the operation of causing the image carrier and the transfer roller to rotate while the recording paper is stopped in the nip area is ended, and causes the power supply section to apply a bias of the normal charge polarity to the transfer roller after performing, for a predefined period of time, the operation of causing the image carrier and the transfer roller to rotate while the recording paper is stopped in the nip area.

8. The image forming apparatus according to claim 1, further comprising a counting section counting a number of pieces of printed paper, wherein in a case where the number of pieces of printed paper is less than a predefined number, the operation control section executes the cleaning operation mode during a non-image-formation period, and in a case where the number of pieces of printed paper is equal to or greater than the predefined number, the operation control section does not execute the cleaning operation mode.

9. The image forming apparatus according to claim 1, further comprising a counting section counting a number of pieces of printed paper, wherein in a case where the number of pieces of printed paper is less than a predefined number, the operation control section causes, during a non-image-formation period, the developing section to supply the predefined amount of toner and executes the cleaning operation mode, and in a case where the number of pieces of printed paper is equal to or greater than the predefined number, the operation control section causes, during the non-image-formation period, the developing section to supply a smaller amount of toner than the predefined amount and executes the cleaning operation mode.

* * * * *